United States Patent [19]

Disney

[11] Patent Number: 4,774,939

[45] Date of Patent: Oct. 4, 1988

[54] EMERGENCY BREATHING AND WARNING DEVICE

[76] Inventor: Alfred L. Disney, Rte. 1, Box 875, Ocran Rd., White Stone, Va. 22578

[21] Appl. No.: 69,213

[22] Filed: Jul. 2, 1987

[51] Int. Cl.[4] ..... A62B 7/12

[52] U.S. Cl. ..... 128/200.24; 116/307; 116/173; 52/221

[58] Field of Search ..... 128/202.26, 200.24, 128/206.28, 206.12, 205.29; 116/306, 307, 173; 98/89, 40.19; 52/221; 137/899.4, 358, 360

[56] References Cited

U.S. PATENT DOCUMENTS

| | | | |
|---|---|---|---|
| 94,905 | 9/1869 | McNevey | 128/206.28 |
| 981,706 | 1/1911 | Spencer | 52/221 X |
| 3,238,943 | 3/1966 | Holley | 128/200.24 X |
| 3,563,267 | 2/1971 | Thompson | 137/360 X |
| 3,995,626 | 12/1976 | Pearce, Jr. | 128/202.27 X |
| 4,320,756 | 3/1982 | Holmes | 128/200.24 X |
| 4,373,522 | 2/1983 | Zien | 128/200.24 X |
| 4,467,796 | 8/1984 | Beagley | 128/200.24 X |

FOREIGN PATENT DOCUMENTS

| | | | |
|---|---|---|---|
| 1214998 | 4/1960 | France | 128/200.24 |

*Primary Examiner*—A. Michael Chambers
*Assistant Examiner*—John C. Fox
*Attorney, Agent, or Firm*—Morton J. Rosenberg

[57] ABSTRACT

An emergency breathing and warning system (100) is disclosed to provide an emergency means of obtaining fresh air for individuals trapped within a building containing noxious fumes or smoke. The emergency breathing and warning system (100) includes flanged conduit (122) which passes through an exterior partition (125) or other structural element to provide access to fresh air external to the building. System (100) includes a first breathing apparatus (104) having a breathing mask (112) coupled to a breathing tube (106). Breathing tube (106) passes through conduit (122) to access the fresh air external to the building. First breathing apparatus (104) includes filter element (108) and coupling (110). Coupling (110) provides a means for providing fresh air to a second breathing apparatus (114) having breathing mask (118) and second breathing tube (116) which is frictionally engaged with coupling (110). Coupling (110) further includes sealing cap (140) for sealing coupling (110) when second breathing apparatus (114) is not in use. Warning device (102) is coupled to breathing tube (106) to provide an external visual indication that the emergency breathing and warning system (100) is in use. Warning device (102) is coupled to first breathing tube (106) by coupling wire (103) to provide a positive deployment and subsequent retraction through conduit (122) by breathing tube (106). A storage container (120) is also provided for maintaining the individual elements of emergency breathing and warning system (100) when system (100) is not in use.

13 Claims, 2 Drawing Sheets

EMERGENCY BREATHING AND WARNING DEVICE

BACKGROUND OF THE INVENTION

1. Field of the Invention

This invention relates to an emergency fresh air breathing and warning device for use within a building in the presence of noxious fumes or smoke. In particular, this invention pertains to an emergency breathing and warning device having a conduit passing through an exterior partition or structural element of a building to provide access to a source of fresh air external to the building. More in particular, this invention relates to an emergency breathing and warning device wherein a breathing apparatus passes through the conduit to fluidly couple the fresh air from the exterior of the building to the individual using the breathing device. Still further, the breathing apparatus includes a filter element for removing particulates and maintaining a toxic free air supply. More in particular, this invention directs itself to an emergency breathing device which includes a warning device to signal those external to the building of the use of the emergency breathing device and signalling the need for help. Further, the warning device is coupled to the breathing apparatus for quick and easy deployment through the conduit to the exterior of the building. Still further, this invention pertains to an emergency breathing and warning device having a sealable coupling for attachment of a second breathing apparatus to the first breathing apparatus and dividing the fresh air therebetween. Still further, the emergency breathing and warning device further includes a storage container for maintaining the first breathing apparatus and the second breathing apparatus convenient for use.

2. Prior Art

Emergency breathing systems are well-known in the art. The closest prior art known to Applicant includes U.S. Pat. Nos. 94,905; 807,597; 835,075; 870,407; 1,040,311; 1,263,595; 4,165,738; 4,320,756; 4,331,139; 4,373,522; 4,467,796; and, 4,565,152.

In some prior art systems, such as shown by U.S. Pat. No. 807,597, there are provided an emergency breathing device whereby fresh outside air may be supplied to a person inside a room of a building using an inlet tube in a window frame or a wall connected to flexible tubing and having a mask on the opposite end. However, such prior art systems do not provide for a warning device which is positively deployed an easily retracted in cooperation with use of the breathing apparatus.

In other prior art systems such as shown in U.S. Pat. Nos. 4,331,139, and 4,320,756, there are provided emergency breathing apparatus which are coupled to soil or waste vents within the structure for providing breathable air. In such prior art systems, a breathing tube is provided for insertion through the water trap of a toilet to access fresh air from the sewer line vent pipe. Still in other such prior art systems, breathing masks are coupled to air collectors which communicate with soil or waste vents within a structure. However, such systems do not provide for a means for deploying a warning device which can be positively and reversibly deployed in conjunction with use of the breathing apparatus. Such prior art systems are either not readily retrofittable to existing structures or very limited in the number of systems which may be deployed within a building, such as being limited by the number of toilets through which access to the sewer vent can be obtained.

In other prior art systems such as that shown in U.S. Pat. No. 4,373,522, such provides an emergency fresh air supply device to provide air to one or more persons in a room along the perimeter of a building. In such prior art systems, breathing masks are connected through tubing to fresh air supplied through a chamber extending through the building wall to the outside. A closure cap is contained on the outer end of the chamber and when open, functions as a baffle to force smoke which is rising up along the buildings outside away from the mouth of the chamber. A ribbon coupled to the closure cap is provided which may be perceivable by outsiders to warn them that people in the room are in danger. However, such systems having a large rectangular chamber are not easily retrofittable into existing structures. The large rectangular chamber is further not adaptable to be mounted through window mullions, as is the case for the subject invention. In addition, such prior art systems do not provide for a means for closing off breathing masks and/or the tubing they are coupled to when not in use. Such lack of a closure for unused taps into the air supply presents a serious problem for such prior art systems, as they have no means to prevent infiltration of contaminated air from the interior space through the unused masks. In contradiction, the subject invention provides a sealable coupling for attachment of a second breathing apparatus. Unlike prior art systems, the coupling of the subject invention includes a sealing cap for maintaining the integrity of the air supply when the second breathing apparatus is not used.

Additionally, such references do not provide for the positive deployment of the warning device and simple retraction method of the subject invention. Such prior art systems depend on air currents to deploy a warning device, but couple that warning device to an air deflector whose design intent is to direct the air currents away from the cavity in which the warning device is maintained. Furthermore, in such prior art systems, no means for retracting the warning device, once deployed, from inside the building is provided. In contradiction, the subject invention provides a positive means of deployment for its warning device not dependent on air currents or other unknown factors. Further, the warning device is easily retracted from within the building space unlike the prior art systems.

SUMMARY OF THE INVENTION

An emergency breathing and warning device which can be used by a person from within a building includes a conduit which establishes access to the fresh air external to the building. The device includes a respiration apparatus, part of which passes through the conduit, and thus couples the fresh air external to the building to the person within. The respiration apparatus includes a warning device adapted to reversibly pass through the conduit for deployment exterior of the building. The device further includes a storage container for maintaining the respiration apparatus convenient for use.

DESCRIPTION OF THE PREFERRED EMBODIMENTS

Figure 1:
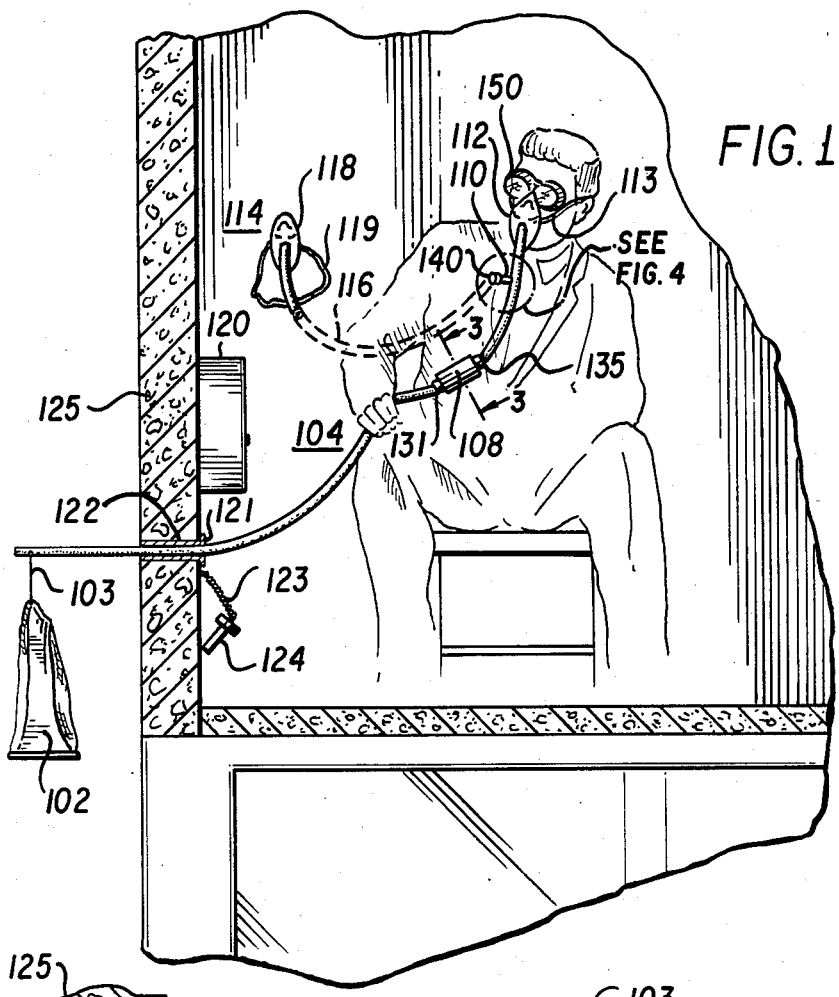
FIG. 1 is a perspective view of the emergency breathing and warning device shown in the deployed condition.

The emergency breathing and warning system 100 shown in FIGS. 1–5, provides a means to obtain fresh air while trapped in a building filled with noxious fumes or smoke. The emergency breathing and warning system 100 in addition to providing a source of fresh air provides a means to alert those external to the building that someone is trapped inside and requires assistance.

In overall concept, emergency breathing and warning system 100 provides an access channel by way of flanged conduit 122 through which a breathing assembly 104 can access fresh air from the exterior of a building. The emergency breathing and warning system 100 includes a means for dividing the air supply established by breathing assembly 104 to permit the addition of a second breathing assembly 114 access to the outside air supply. The visual warning device 102 is coupled to the breathing assembly 104 for easy deployment and retraction.

Referring now to FIG. 1, there is shown emergency breathing and warning system 100 shown deployed for use to protect an individual from noxious fumes or smoke, as may be present during a fire or chemical accident. System 100 includes flanged conduit 122 shown passing through exterior wall 125 of a building structure. Flanged conduit 122 may be retained within exterior wall 125 by adhesive means or by flaring the exterior end of flanged conduit 122. A conduit plug 124 is provided to seal flanged conduit 122 when system 100 is not in use. Conduit plug 124 is coupled to flanged conduit 122 by tether 123 which provides a convenient means for maintaining conduit plug 124 within easy access after system 100 has been used.

System 100 includes first breathing apparatus 104 and second breathing apparatus 114. First breathing apparatus 104 includes breathing mask 112 coupled to a breathing tube 106. Breathing tube 106 includes filter element 108 for maintaining a clean and toxic free air supply. Located between breathing mask 112 and filter element 108 on breathing tube 106, is provided coupling 110 for attachment of second breathing apparatus 114. Coupling 110 includes sealing means 140 for maintaining the fluid integrity of first breathing apparatus 104 when second breathing apparatus 114 is not being used.

Second breathing apparatus 114 includes breathing mask 118 coupled to breathing tube 116. Breathing tube 116 is frictionally attached within coupling 110 to provide fluid coupling between breathing tube 106 of first breathing apparatus 104 and second breathing apparatus 114. Thus, when only first breathing apparatus 104 is being utilized, coupling 110 is sealed by sealing means 140 permitting the air exchange to take place through breathing tube 106. When second breathing apparatus 114 is coupled to first breathing apparatus 104 by means of coupling 110, breathing tube 106 provides an air exchange for both first and second breathing apparatus 104 and 114, respectively. The air flow through breathing tube 106 is divided at coupling 110 permitting a portion of the fresh air to be coupled through breathing tube 116 to breathing mask 118 for use by the second individual. The remaining portion of the fresh air within breathing tube 106 is coupled to breathing mask 112 for use by the individual who has put on breathing mask 112. Breathing masks 112 and 118 are provided with retention straps 113 and 119, respectively to secure the respective breathing apparatus 104 and 114.

System 100 includes a visual warning device 102 coupled to the distal end of breathing tube 106 by coupling wire 103. Warning device 102 consists of a brightly colored flag having the approximate dimensions 3" in width and 12" in length. Warning device 102 may be composed of a cloth material or any of a number of plastic films commonly used for flags or banners.

Included in system 100 is storage container 120 for maintaining the first breathing apparatus 104 and second breathing apparatus 114 convenient for use in the event of a condition where noxious fumes or smoke are present. Included in storage container 120 are eye protection goggles 150 for protection from eye irritants which may be present as part of the noxious fumes or smoke which precipitated the use of system 100. Storage container 120 is shown mounted to exterior wall 125, but may be located in any convenient space such as in the drawer or closet. Unlike some prior art systems, system 100 having storage container 120 separate from flanged conduit 122, permits each to be located more ideally to their respective functions. Thus, storage container 120 may be mounted at a convenient eye level height for rapid access and utilization. Flanged conduit 122 may be located at a position close to the floor where the interior air is less likely to be contaminated in the presence of noxious fumes or smoke and thus, providing more time to deploy first and second breathing apparatus 104 and 114.

Flanged conduit 122 has been designed to facilitate quick and easy installations in existing structures. Flanged conduit 122 being a tubular structure, is easily installed through a drilled hole formed through an exterior wall or structural element such as a window mullion. Flanged conduit 122 may be retained within the formed hole through exterior wall 125 or other structural element, by adhesive coupling or flaring the distal end of flanged conduit 122, which frictionally secures flanged conduit 122 to the structural eember through which it passes.

Figure 2:
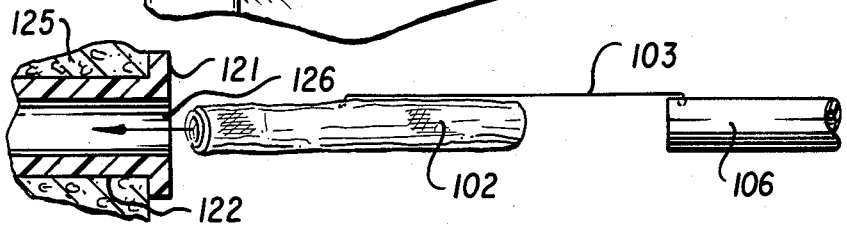
FIG. 2 is a detail showing the method of deploying the warning device as shown in FIG. 1.

Referring now to FIG. 2, there is shown the means by which warning device 102 is deployed through flanged conduit 122. As shown, flanged conduit 122 having a flange 121 located on the interior surface of exterior wall 125 forms a passage 126 through exterior wall 125. Warning device 102 is rolled about itself to permit easy passage through opening 126. As has been previously stated, warning device 102 is coupled t the distal end of breathing tube 106 by coupling wire 103.

Coupling wire 103 is sufficiently stiff to push the rolled warning device 102 through conduit 122 Once warning device 102 has exited flanged conduit 122 to the exterior of the building, warning device 102 will unroll, as shown in FIG. 1, due to the force of gravity and become fully deployed to provide a visual indication that assistance is required on the interior of the building.

When breathing tube 106 is retracted from conduit 122, coupling wire 103 retracts warning device 102 by pulling it through conduit 122. Warning device 102 is sufficiently flexible to pass through conduit 122 in the unrolled condition, and thus, a system is provided for reliably deploying warning device 102 coincident with establishing a fresh air supply through breathing apparatus 104. Similarly, a convenient and reliable method for retraction of warning device 102 is provided in combination with the withdrawal of breathing tube 106.

Figure 3:
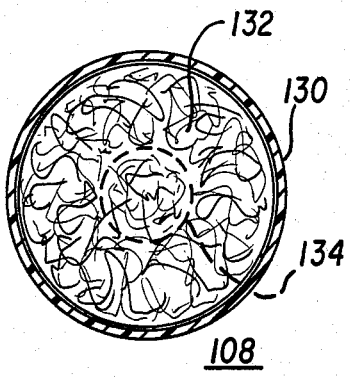
FIG. 3 is a sectional view of the filter element shown in FIG. 1.

Referring now to FIG. 3, there is shown a cross-sectional view of filter element 108. Filter element 108 is a conventional air filtration type device having an outer wall 130 and an inner perforated tube 134. The space provided between perforated tube 134 and outer wall 130 is filled with filter media 132.

The inlet for air to be filtered is located a the distal end 131 of filter element 108, as shown in FIG. 1. The fresh air drawn into filter element 108 by the inhalation of the user of system 100 passes from inlet 131 through the filter media 132 and into the perforated outlet tube 134. Perforated outlet tube 134 couples the fresh air supply to the filter outlet 135, shown in FIG. 1.

Filter media 132 may be a combination of glass wool and activated charcoal to maintain the fresh air supply free of particulates and toxic materials. Filter media 132 may contain other chemical agents which are directed to remove specific toxins which may be deemed appropriate in light of the industrial environment to which system 100 is to be employed.

Figure 4:
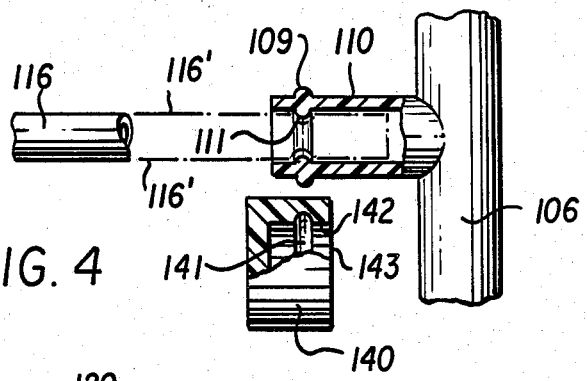
FIG. 4 is a detail and sectional view of the sealable coupling provided in the breathing apparatus shown in FIG. 1; and, FIG. 5 is a front elevation of the storage container showing the system in operative condition.

Referring now to FIG. 4, there is shown a detail of coupling 110 provided to divide the fresh air supply between first breathing apparatus 104 and second breathing apparatus 114. Coupling 110 is suitably coupled, by methods well known in the plastic arts, to breathing tube 106 to provide access to the fresh air supply flowing through breathing tube 106 by the second breathing apparatus 114. Second breathing tube 116 is inserted into coupling 110 where it is frictionally retained by retaining ring 111 formed within coupling 110 When breathing tube 116 is inserted into coupling 110 as shown by the phantom lines 116', retention ring 111 provides both a retention means for breathing tube 116 and a sealing means to prevent contaminated air from entering through coupling 110 when breathing tube 116 is there attached.

Coupling 110 further includes a retention ring 109 forming a raised flexible ring on the exterior surface of coupling 110 for matingly coupling with sealing cap 140. Sealing cap 140 includes outer wall 142 which defines interior space 143 adapted to fit over coupling 110 and provide a seal to prevent infiltration of contaminated air through coupling 110 when second breathing apparatus 114 is not in use. Sealing cap 140 includes groove 141 formed on the inner surface of wall 142 for coupling with retaining ring 109 to provide a positive retention and sealing between sealing cap 140 and coupling 110. Sealing cap 140 and coupling 110 are composed of suitable plastic materials having sufficient flexibility to provide a reversible "snaplock" coupling.

Thus, has been provided a coupling means to the fresh air supply provided by breathing tube 106 which has the ability to couple fresh air to a second breathing apparatus 114 by insertion of second breathing tube 116 into coupling 110 where it is frictionally retained by retention ring 111. Retention ring 111 also forms a gas seal in combination with the exterior wall of breathing tube 116 to prevent infiltration of contaminated air. Coupling 110 further includes sealing cap 140 which is adapted to fit over the exterior surface of coupling 110 and is there retained by retention ring 109 in combination with groove 141 formed within the outer wall 142 of sealing cap 140. This provides a method of sealing coupling 110 from infiltration of contaminated air when second breathing apparatus 114 is not in use.

Figure 5:
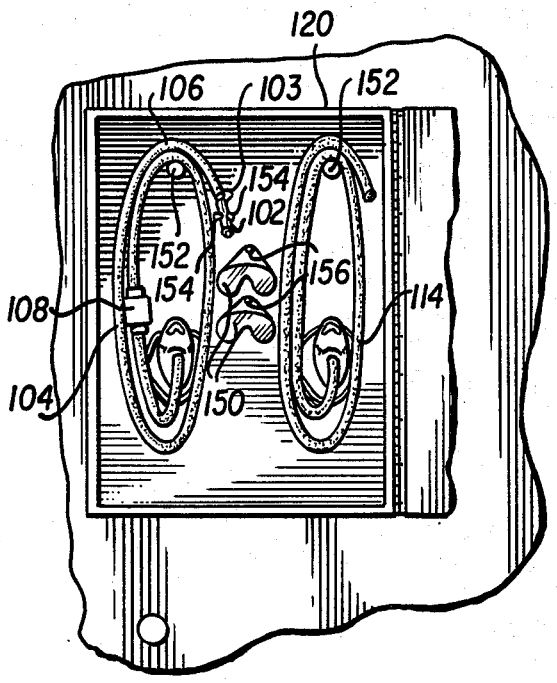

Referring now to FIG. 5, there is shown storage container 120 having hanging supports 152 for maintaining first breathing apparatus 104 and second breathing apparatus 114. Hanging supports 154 of storage container 120 provide a means to maintain warning device 102 in a rolled, ready for deployment condition coupled by coupling wire 103 to first breathing tube 106. Also included in storage container 120 are hanging supports 156 for maintaining eye protection goggles 150 available for use with first and second breathing apparatus 104 and 114, respectively.

As previously stated, storage container 120 may be located in close proximity to flanged conduit 122 or remotely located to be more convenient for access by individuals who might have need of system 100. This permits flanged conduit 122 to be located close to the floor where the air within the occupied space is likely to less contaminated, thus providing more time for an individual to deploy system 100.

Locating flanged conduit 122 close to the floor level also provides for a more aesthetically pleasing installation. The ability to independently locate flanged conduit 122 separate from storage container 120 permits the installation of flanged conduit 122 through structural elements other than exterior walls. Structures such as window mullions or other extruded aluminum structural elements through which holes can easily be formed to accept the installation of flanged conduit 122 can be used to provide an aesthetically pleasing low cost installation.

Emergency breathing and warning system 100 provides a unique means for deploying and retracting warning device 102. Warning device 102 is provided with a positive means of deployment, as it is pushed through conduit 122 by breathing tube 106 in combination with coupling wire 103. Thus, once breathing tube 106 has established the airway on the exterior of the building, it is certain that warning device 102 has exited conduit 122 being suspended from the breathing tube 106 by coupling wire 103. Retraction of warning device 102 is similarly positive, as it is pulled back through conduit 122 as breathing tube 106 is withdrawn being pulled by coupling wire 103 which is in turn pulled by breathing tube 106.

Flanged conduit 122 is provided a simple means of installation through exterior wall 125 or any other suitable partition such as a window mullion. Conduit 122 may be secured through the opening formed in the structural element by adhesive means or by flaring the distal end of conduit 122. Conduit 122 includes conduit plug 124 for sealing the opening to the external environment formed by conduit 122. Conduit plug 124 prevents the infiltration of the external environment (heat or cold) when emergency breathing and warning system is not in use. Conduit plug 124 is maintained in the proximity of conduit 122 by tether 123 when system 100 is in use. Thus, once first breathing apparatus 104 has been used and subsequently retracted, conduit plug 124 will be readily available for closure of the opening through conduit 122.

Although this invention has been described in connection with specific forms and embodiments thereof, it will be appreciated that various modifications other than those discussed above may be resorted without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An emergency breathing and warning device for use by at least one person from within a building, comprising:

(a) conduit means for establishing access to a source of fresh air external said building, said conduit means including a hollow tube having a first end and a second end extending through an outside wall of said building, said first and second ends being located internal and external said outer wall respectively, said hollow tube being formed of a metallic composition having an internal diameter approximately 0.75 inches, said conduit means further including a plug releasably coupled to said first end of said hollow tube;

(b) respiration means passing through said conduit means for coupling said fresh air source to said person, said respiration means including said warning device, said warning device being adapted to reversibly pass through said conduit means for deployment external said building, said respiration means including a first breathing tube having an outside diameter less than said inside diameter of said hollow tube, said first breathing tube having a first end for passage through said hollow tube to access said fresh air source, said warning device being coupled to said first end of said first breathing tube, said warning device being retracted from said deployment coincident with removal of said first breathing tube; and, (c) storage means for maintaining said respiration means convenient to said person or said conduit means when said respiration means is not in use.

2. The emergency breathing and warning system as recited in claim 1 where said respiration means includes a first breathing tube, said first breathing tube includes filter means for maintaining a substantially toxic free air supply.

3. The emergency breathing and warning system as recited in claim 2 where said respiration means includes a first breathing mask coupled to said first breathing tube.

4. The emergency breathing and warning system as recited in claim 3 where said first breathing tube includes an auxiliary coupling located between said filter means and said first breathing mask.

5. The emergency breathing and warning system as recited in claim 4 where said respiration means further includes (1) a second breathing mask and (2) a second breathing tube, said second breathing tube coupled on a first end to said second breathing mask, said second breathing tube being adapted on a second end for coupling to said auxiliary coupling of said first breathing tube, said auxiliary coupling having a sealing means for prevention of contaminated air infiltration into said first breathing tube when said second breathing tube is decoupled from said first breathing tube.

6. The emergency protection system as recited in claim 1 where said warning means is a brightly colored flag.

7. The emergency protection system as recited in claim 1 where said storage means contains eye protection members for use with said respiration means when said noxious fumes or smoke may be an eye irritant.

8. An emergency protection system for use in the presence of noxious fumes or smoke by at least one person trapped within a building, comprising:

(a) conduit means passing through an external partition of said building for establishing a passageway to an exterior of said building, said conduit means defining a hollow tube, includes a conduit plug for sealing said conduit means when said noxious fumes or smoke are not present;

(b) respiration means passing through said conduit means for establishing an airway from said exterior of said building to said person subsequent to removal of said conduit plug, said respiration means including means for fluidly dividing said airway from said exterior of said building for use by a second person, said means for fluidly dividing said airway includes a sealing means for disabling said means for fluidly dividing said airway when only one person is using said system, said respiration means including a first breathing assembly, said first breathing assembly having (1) a first breathing mask and (2) a first breathing tube having a first end coupled to said first breathing mask and a second end being adapted for passage through said hollow tube, said first breathing tube including filter means for maintaining a substantially toxic free air supply;

(c) warning means coupled to said respiration means for indicating when said emergency protection system is in use, said respiration means providing deployment and retraction of said warning means, said warning means being coupled to said second end of said first breathing tube, said warning means being retracted from deployment coincident with removal of said first breathing tube from said hollow tube; and, (d) storage means for maintaining said respiration means and said warning means convenient for use.

9. The emergency protection system as recited in claim 8 where said conduit means includes a hollow tube flanged on a first end, said hollow tube having a second end extending through said external partition of said building.

10. The emergency protection system as recited in claim 9 where said hollow tube is of metallic composition having an internal diameter approximating 0.75 inches.

11. The emergency protection system as recited in claim 10 where said first breathing tube further includes said means for fluidly dividing said airway located upstream said filter means.

12. The emergency protection system as recited in claim 11 where said respiration means further includes a second breathing assembly, said second breathing assembly includes, (1) a second breathing mask and (2) a second breathing tube having a first end coupled to said second breathing mask and a second end being adapted for fluid coupling to said means for fluidly dividing said airway.

13. The emergency protection system as recited in claim 12 where said warning means is coupled to said second end of said first breathing tube.

* * * * *